United States Patent [19]

Cone

[11] 4,186,454

[45] Feb. 5, 1980

[54] PORTABLE PLAYPEN

[76] Inventor: Richard E. Cone, 249 Bowman Dr., Kent, Ohio 44240

[21] Appl. No.: 944,143

[22] Filed: Sep. 20, 1978

[51] Int. Cl.[2] ..... A47C 27/08

[52] U.S. Cl. ..... 5/99 R; 5/99 C

[58] Field of Search ..... 5/97, 98 R, 99 R, 99 BD, 5/110; 256/25

[56] References Cited

U.S. PATENT DOCUMENTS

| | | | |
|---|---|---|---|
| 3,206,772 | 9/1965 | Sarasin | 5/98 R |
| 3,789,439 | 2/1974 | Berg et al. | 5/98 R |
| 4,069,524 | 1/1978 | Carlo | 5/99 R |

*Primary Examiner*—Casmir A. Nunberg

[57] ABSTRACT

A multi-sided playpen having a frame structure comprising upper corner hinge brackets pivotally interconnected by a plurality of substantially centrally hinged railings with a plurality of X-shaped structures, pivoted substantially at their center points interconnecting the upper corner hinge brackets to a like number of lower corner hinge brackets so that the entire structure is collapsable. A releasable locking means is connected between each of X-shaped structures and said centrally hinged railings, and a flexible liner is supported within the playpen.

10 Claims, 11 Drawing Figures

FIG. 7
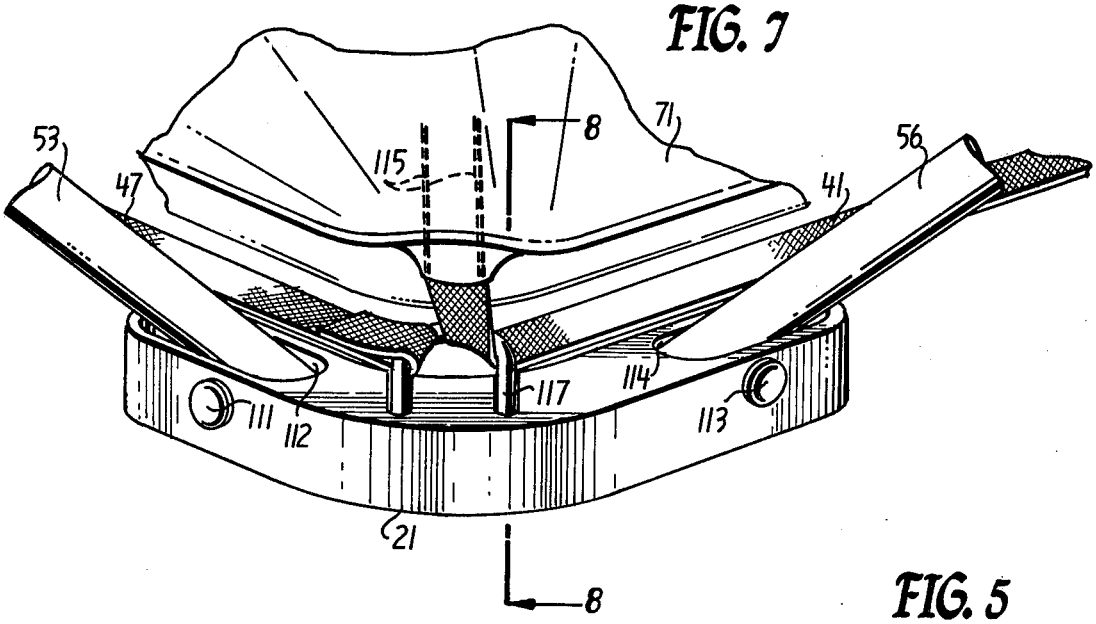
FIG. 5
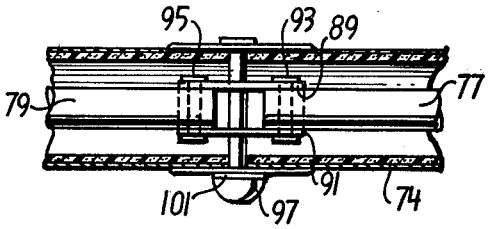
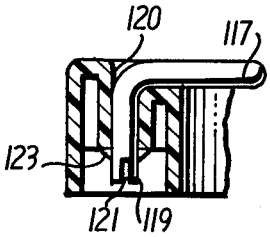
FIG. 8
FIG. 6
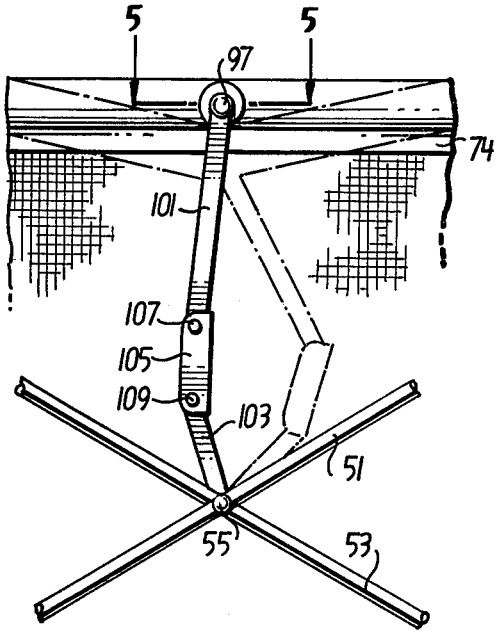

PORTABLE PLAYPEN

This application relates generally to playpens and more specifically to a collapsable playpen which, when collapsed, requires minimal space and is portable.

Playpens are well known and have been in use for many years. The earliest pens were usually constructed of wood and many were secured together by means of screws and wing nuts which could be removed so that the pen could be disassembled. However, this was a tedious job and therefore did not, in effect, make the playpens truly collapsable and portable.

Subsequent playpens were designed which were hinged in various places but still required a dismantling of the basic structure so as to allow them to be stored or allow them to be easily carried from place to place.

Accordingly, it is an object of this invention to provide a collapsable playpen.

An additional object of the invention is to provide a collapsable playpen formed of a tubular structure having a light weight flexible pen material contained therein.

Yet another object of this invention is to provide a collapsable playpen which folds into a minimal four post type structure which may be secured together by a strap so as to become easily portable.

These and other objects of the invention will become obvious from the following description taken together with the accompanying drawings wherein FIG. 1 is a perspective view of the playpen of the present invention in its erected position ready for use;

FIG. 5 is a sectional view taken through the lines 5—5 of FIG. 6;

FIG. 6 is a partial elevational view showing the over-center hinge used in the present invention;

FIG. 7 is a perspective view of a lower hinge bracket shown generally in FIG. 1;

FIG. 8 is a sectional view taken through the lines 8—8 of FIG. 7;

Figure 1:
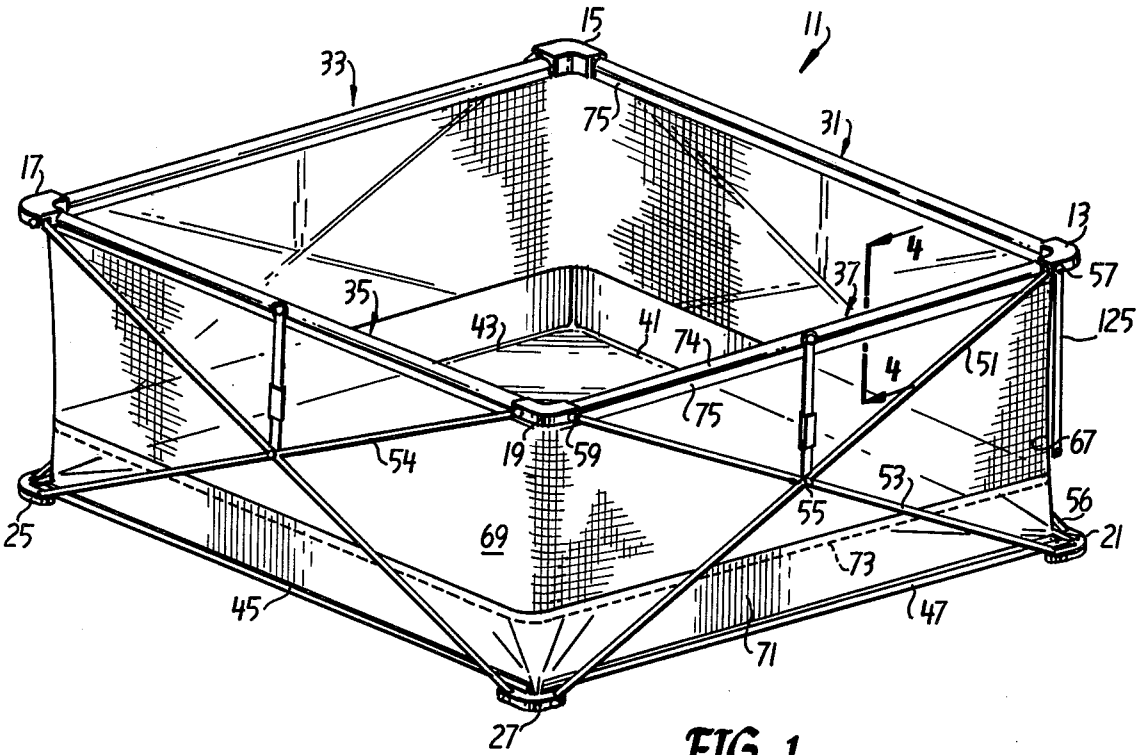
Figure 2:
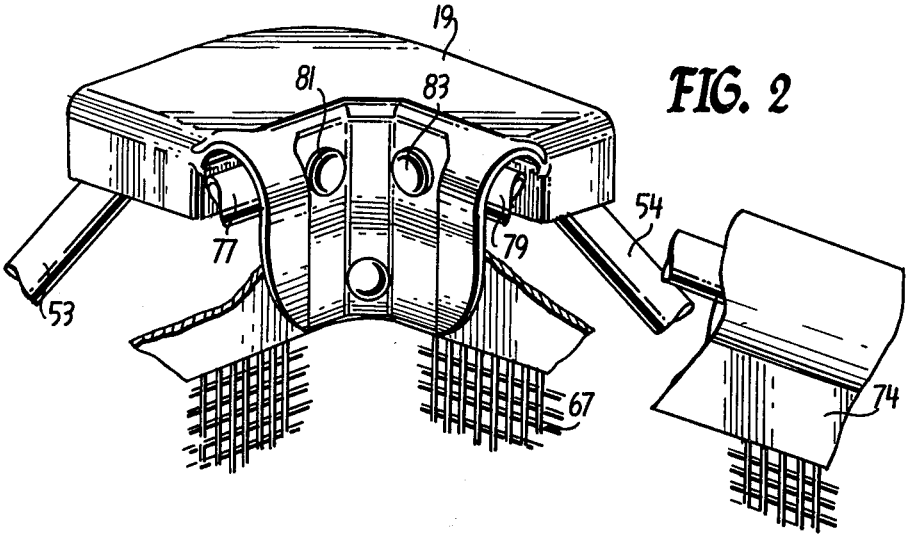
FIG. 2 is a perspective view of one of the upper corner hinge brackets.
Figure 3:
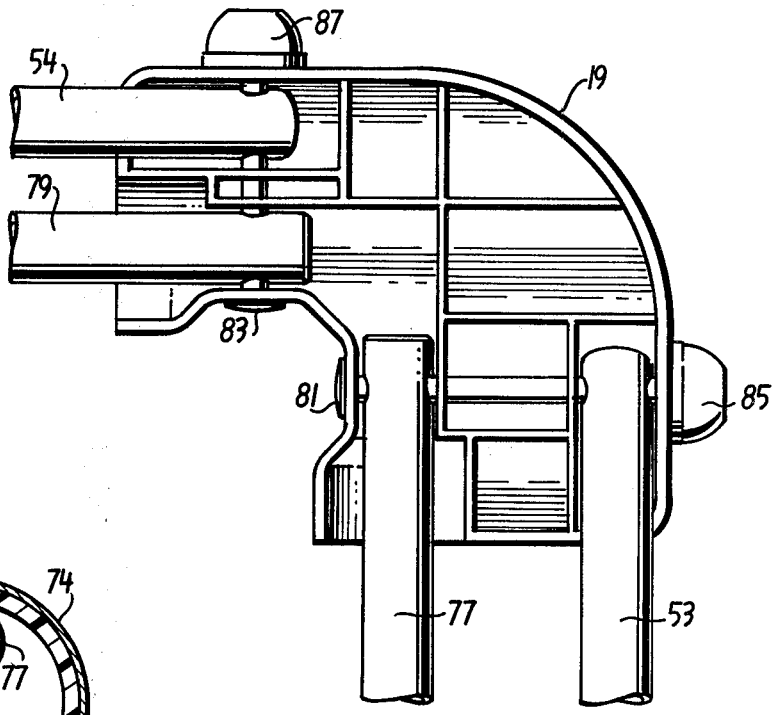
FIG. 3 is a bottom view of the hinge brackets of FIG. 2.

Turning now more specifically to the drawings, there is shown in FIG. 1 a perspective view of the playpen of the present invention in its open position ready for use. Playpen 11 has four substantially identical upper corner hinge brackets 13, 15, 17 and 19 and four substantially identical lower corner hinge brackets 21, 23, 25 and 27. In the configuration shown, each of the upper and lower brackets are L-shaped. The upper corner hinge brackets are connected so as to form a square shape by means of the top rails 31, 33, 35 and 37. The lower corner hinge brackets are interconnected by means of flexible bands 41, 43, 45 and 47 as will be more particularly disclosed as the description proceeds.

Each of the side supports are substantially identical X-shaped structures and each consists of rod members 51 and 53 which cross substantially at their center point 55 and are pivoted thereat. The pivot point 55 and the substantially center portion of the upper rail 31 are interconnected by means of an overcenter hinge, more clearly shown in FIG. 9, comprised of elements 101, 103 and 105.

The playpen frame supports an open mesh which may be of nylon or like material and which is maintained between the upper and lower brackets so as to form a substantially rectangular liner having a flexible floor 69 of a material such as vinyl which extends upwardly to form side panels 71 having stitching 73 interconnecting the mesh with the flooring material.

Figure 4:
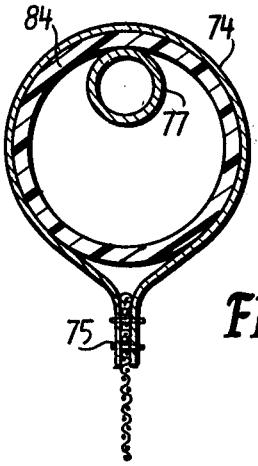
FIG. 4 is a sectional view taken along the lines 4—4 of FIG. 1.

Turning now more specifically to FIGS. 2 through 6, it can be seen that the ends of the top rails, here designated as 77 and 79, are pivotally connected within the top rail 13 by means of pivot pins 81 and 83. The pivot pins pass completely through the structure including the rod members 53 and 54, as is clearly shown in FIG. 3, and may be secured by means of caps 85 and 87 which are force fit on the end of the pivot pins. Rods 53 and 54 form part of adjacent X-shaped structures. As is also shown, the flexible rail covering 74 passes over rod 53 and the other similar rods comprising the upper part of the playpen. FIG. 4 illustrates that this flexible railing covering 74 passes over and is maintained by a tubular member 84 made of plastic material or the like. This tubular material in turn rests against rail 77 with the material 74 being secured to the netting by means such as stitching 75.

All of the upper rails are formed of two separate rails such as illustrated in FIG. 5. Rails 77 and 79 are joined together by means of a U-shaped member having legs 89 and 91 which fit about the ends of each of rails 77 and 79 and are secured thereto by means of pivot pins 93 and 95. This allows for the construction as illustrated more particularly in FIG. 6 wherein the pivot point 55 is interconnected to the pivot pin 97 joining the upper rail 77 and 79 by an over-center lock mechanism composed of the rigid arms 101 and 103 interconnected by a U-shaped plate 105, said plate being pivoted at 107 and 109 to each of these arms 101 and 103. In the position shown in the full lines of FIG. 6 the over-center mechanism is shown in a locked position. The dotted lines illustrate the collapsing of the various upper members when the pen is folded so as to ultimately be placed in the folded and stored position shown in FIG. 9.

FIGS. 7 and 8 illustrate the operation and mechanisms used in connection with the lower corner hinge brackets. All of these brackets are substantially identical and therefore the description of only one is felt to be required. There is shown an L-shaped lower corner bracket 21 having recesses 112 and 114 in the upper base thereof. The lower ends of rod members 53 and 56 extend into these recesses and are pivotally retained therein by means of pivot pins 111 and 113. As can be seen, the limit to which the rod members 56 and 53 may be lowered is controlled by the upper outer edge of recesses 112 and 114. As is more clearly indicated in FIG. 8, a U-shaped retainer loop 117 having legs 119 fits into an aperture 120 within the corner hinge bracket 21. A slit 121 in leg 119 allows the lower end of the legs 119 to pass through the aperture and then expand for a snap closure using the lips 123 in a well known fashion. Retainers 117 secure the various flexible straps such as 41 and 47. The illustration of FIG. 7 shows one end of one of the straps, which are all identical, as being secured about one end of the retainer 117 as is strap 47. The other end of the strap extends upwardly into the extending sides 71 of the flooring and is stitched thereto by means of stitching 115.

Figure 9:
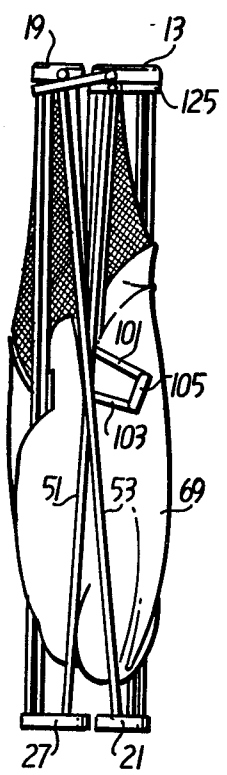
FIG. 9 is a perspective view of the playpen of FIG. 1 shown in its collapsed and folded position

As will now be obvious, the entire structure may be easily folded by biasing the over-center springs to an unlocked position and placing ones foot on any one of the four corner posts. The playpen may then be lifted upwardly as it collapses until a position is reached wherein it is folded as shown in FIG. 9. If desired, a strap 125 having mating snaps may be secured to one of the upper brackets by the pivot pins so as to secure the playpen in its upward folded position.

Figure 10:
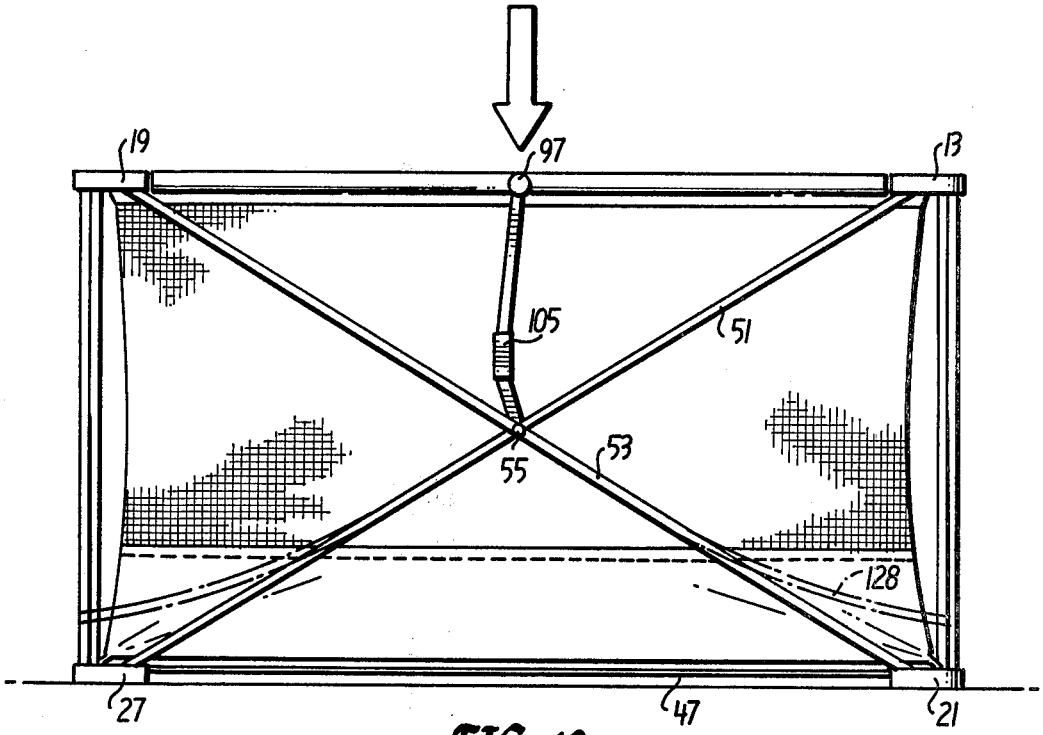
FIG. 10 is an elevational view of one side of the pen of FIG. 1.

FIG. 10 illustrates further advantages provided by the structure of the present invention. Because of the upward action required in order to collapse the playpen, there is provided a safety function as well as a supporting function. This safety feature occurs since the unlocking of all four top rail devices would still not allow the top rails to fully collapse as in conventional playpens.

It is further noted that routing and connecting the tension straps, such as straps 41 and 47 as shown in FIG. 7, prevents the base from spreading. The passing of the strap through the retainer 117 and connecting the loose end to the retainer in the adjacent bottom corner hinge bracket prevents the base from spreading when weight is placed on the top rail. The effect of such weight without the straps is indicated in FIG. 10 by the dotted lines 128. Additionally, the tension straps will pull the corners of the mesh down to the bottom of the four corners of the frame during unfolding. It should be noted that the straps could be secured to adjacent lower hinge brackets if some other type of tensioning system were used for the liner.

Figure 11:
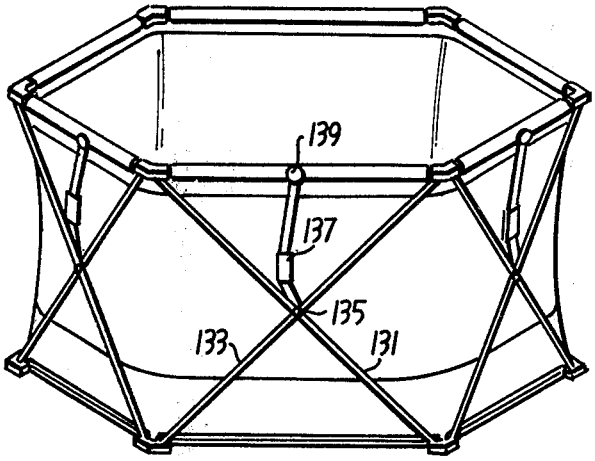
FIG. 11 is a schematic illustration of a modification of the present invention.

FIG. 11 discloses a modification of the above described invention. There is illustrated a playpen having six sides which are each identical and substantially the same as the sides described above in that they include an X-shaped structure formed by rods 131 and 133 joined by pivot pin 135 and a locking hinge 137 connected between pin 135 and pivot pin 139. The X-frame scissoring action during folding and unfolding of the playpen will function properly with an even number of centrally located hinge points, i.e., 4,6,8, etc., so as to form a multi-sided playpen.

While the invention is illustrated as using tubular material, it is to be understood that other materials or structural components may be equally effective in accomplishing the desired function.

It is to be understood that the above description and drawings are illustrative only since specific equivalent components could be substituted without departing from the invention which is to be limited only by the scope of the following claims.

I claim:

1. A multi-sided playpen having a frame structure comprising a plurality of upper corner hinge brackets between adjacent sides of said playpen;

a plurality of substantially centrally hinged railings;

means for pivotally connecting the ends of said railings to said upper corner hinge brackets so as to substantially form a multi-sided structure;

a plurality of lower corner hinge brackets between adjacent sides of said playpen;

a plurality of X-shaped structures equal in number to the sides of said playpen, each of said structures being pivoted substantially at their center points;

means for pivotally connecting the free ends of each of said X-shaped structures to adjacent said upper and lower bracket members so as to form said multi-sided playpen; and releasable locking means connected between each of X-shaped structures and said centrally hinged railings.

2. The apparatus of claim 1 further comprising a flexible liner; and means for supporting said flexible liner within said frame structure.

3. The apparatus of claim 1 wherein said releasable locking means comprises at least one over-center hinge;

means for pivotally connecting one end of said over-center hinge to the center point of one of said X-shaped structures; and means for pivotally connecting the other end of said over-center hinge to one of said railings adjacent said X-shaped structure.

4. The apparatus of claim 1 wherein said frame structure comprises four sides which substantially form a square.

5. The apparatus of claim 2 further comprising a plurality of flexible straps each connected at one end to said flexible liner above each of said lower corner hinges;

a retainer loop secured to and extending outwardly from each of said lower corner hinges, said flexible straps passing through said adjacent retainer loops; and means for securing the other end of said straps to the next adjacent one of said retainer loops, each of said other ends being secured to different retainer loops.

6. The apparatus of claim 2 further comprising a plurality of flexible straps; and means for securing each of said straps to said flexible liner and said lower hinge brackets so as to maintain said lower hinge brackets in fixed relative positions to each other.

7. The apparatus of claim 2 further comprising a plurality of flexible straps; and means for securing individual straps between adjacent lower hinge brackets.

8. A four-sided playpen, having a frame structure comprising four substantially identical upper corner hinge brackets, each of said upper brackets comprising an L-shaped rigid member;

parallel channels in the lower surfaces of the legs of said L-shaped member and extending to the outer edges thereof;

four substantially identical lower corner hinge brackets, each of said lower brackets comprising an L-shaped rigid member;

a recess in the upper surface of each leg of said lower L-shaped member; four upper railings, each of said upper railings comprising a plurality of rod means connected between opposed upper hinge brackets and pivotally mounted at each end within one of said parallel channels, each of said rod means being hinged substantially midway between said opposed upper hinged brackets;

support means on each of said four sides of said playpen, each of said support structures comprising a pivotally interconnected X-shaped structure;

means for pivotally connecting the upper ends of said X-shaped structure within the other of said parallel channels in opposed said upper hinge brackets;

means for pivotally connecting the lower ends of said X-shaped structure within said recesses in opposed said lower hinge brackets;

a lock means at each of the four sides of said pen pivotally connected between the pivot point of said X-shaped structure and the hinge point of the adjacent upper railing; and a flexible liner supported within said frame structure.

9. The apparatus of claim 8 wherein each of said lock means comprises an over-center hinge;

means for pivotally connecting one end of said over-center hinge to the center point of one said X-shaped structures; and means for pivotally connecting the other end of said over-center hinge to the hinge point of said adjacent upper railing.

10. A collapsable playpen comprising a multi-sided enclosure with each side comprising a collapsable pivotally interconnected x-shaped support structure;

a plurality of upper and lower corner bracket member for joining adjacent support structures;

a substantially centrally hinged railing connected between each adjacent upper corner brackets; and releasable locking means connected between the hinge of at least one of said railings and the pivot of said adjacent support structure.

* * * * *